United States Patent [19]

Osawa et al.

[11] Patent Number: 4,969,333

[45] Date of Patent: Nov. 13, 1990

[54] HEAT PUMP APPARATUS

[75] Inventors: Seiichi Osawa, Kumagaya; Hironobu Oshima; Fusao Terada, both of Ota; Morio Ishii, Tatebayashi; Fumio Saito, Ota, all of Japan

[73] Assignee: Sanyo Electric Co., Ltd., Osaka, Japan

[21] Appl. No.: 444,056

[22] Filed: Nov. 30, 1989

[30] Foreign Application Priority Data

Dec. 16, 1988 [JP] Japan ..... 63-318772

[51] Int. Cl.[5] ..... F25B 9/00

[52] U.S. Cl. ..... 62/6; 60/524; 62/159

[58] Field of Search ..... 62/6, 159; 60/524

[56] References Cited

U.S. PATENT DOCUMENTS 4,455,826 6/1984 Knoos ..... 60/517 X
4,902,952 2/1990 Lavery ..... 62/6

FOREIGN PATENT DOCUMENTS 61-25901 2/1986 Japan .

*Primary Examiner*—William E. Wayner
*Attorney, Agent, or Firm*—Darby & Darby

[57] ABSTRACT

A heat pump apparatus comprising: a heat pump circuit composed of an external combustion engine, a radiator through which a first medium heated by a first heat exchanger of said external combustion engine flows and a cooler through which a second medium cooled by a second heat exchanger of said external combustion engine flows; a motor for supplementing a motive power to said external combustion engine; a brake for braking said external combustion engine; a detector for detecting a heating load; and a controller for calculating a motive power necessary for said external combustion engine based on the difference between a value detected by said detector and a preset value previously set, and for controlling said motor to move when the calculated motive power is larger than a self-output of said external combustion engine.

7 Claims, 7 Drawing Sheets

HEAT PUMP APPARATUS

BACKGROUND OF THE INVENTION (1) Field of the Invention

The present invention relates to a heat pump apparatus comprising a heat pump circuit composed of an external combustion engine, a radiator through which a first medium heated by a first heat exchanger of the aforesaid engine flows and a cooler through which a second medium cooled by a second heat exchanger of the aforesaid engine flows.

(2) Description of the Prior Art

Example of prior art heat pump apparatus of the abovementioned structure, as shown in FIG. 9, is disclosed in, for example, Published unexamined Japanese Patent Application No. 25901/1986 and described on the 16th line of page 146 to the 17th line of page 147 of "Development of Stirling Engines", a Japanese book, issued by Industrial Investigation Co., Ltd. on July 25, 1982, as a reference.

In FIG. 9, reference numeral 1 illustrates an external combustion engine where working gas, for example, the helium gas at 700° to 1,000° K., goes in and out an inside space of a head-side cylinder of a first displacer piston 3 moving up and down in the high temperature-side cylinder 2, and also intermediate temperature level gas, for example, temperature of 300° to 400° K., goes in and out an inside space of another side cylinder. Reference numeral 4 denotes a low temperature side cylinder having a second displacer piston 5. Low temperature level gas, for example, temperature of 200° to 300° K., goes in and out the inside space of said cylinder 4 where the second displacer piston 5 moves left and right, and moreover, intermediate temperature level gas goes in and out an inside space of another side cylinder. Reference numeral 6 denotes a heater tube for heating the working gas of high temperature level, and a fin 7 is provided outside of the heater tube 6. The heater tube 6 is so made as to be heated by combustion gas of a burner which is not illustrated. Reference numeral 8 denotes a regenerator where high temperature level gas (hereafter referred to as high temperature gas) goes in and out the upper opening and also intermediate temperature level gas goes in and out the upper opening. Reference numerals 9 and 10 respectively denote first heat exchangers where intermediate temperature level gas (hereafter referred to as intermediate temperature gas) radiates heat. Reference numeral 11 denotes a regenerator where intermediate temperature gas goes in and out the left side opening and also low temperature level gas (hereafter referred to as low temperature gas) goes in and out the right side opening. Reference numeral 12 denotes an second heat exchanger. Reference numeral 13 denotes a tube through which low temperature gas flows, and reference numeral 14 also denotes a tube through which intermediate temperature gas flows.

Reference numeral 15 denotes a radiator of heating load-side connected with the first heat exchangers 9 and 10 through a warm water pipe line 16. Reference numeral 17 denotes a cooler of cooling load-side connected with the second heat exchanger 12 through a chilled water pipe line 18.

Reference numerals 19 and 20 are connecting rods respectively connected with piston rods 21 and 22 of the first and second displacer pistons 3 and 5. These rods are so connected with a crank 23 as to rotate by mutually keeping a constant phase angle. The rotation axis 24 of the crank 23 is connected with a motor (not illustrated) as a starter. In addition to rotate the rotation axis 24 in the right direction as shown by the allow, the first and second displacer pistons 3 and 5 can be moved by keeping a constant phase difference. Further, the diameter of the piston rod 22 of the second displacer piston 5 is so constructed as to be larger than that of piston rod 21 of the first displacer pistons 3. Also, reference numeral 25 denotes a crank case which is separated respectively from the cylinders 2 and 4 by partition walls 26 and 27.

According to the heat pump apparatus constituted in the manner as abovementioned, as the first and second displacer pistons 3 and 5 move by keeping a constant phase difference, the temperature is lowered caused by the expansion of low temperature gas inside the head-side space of the low temperature side cylinder 2. And, the low temperature gas of which temperature is lowered acts to absorb the heat of chilled water when the gas passes through the second heat exchanger 12. Thereby, the chilled water of which temperature is lowered is supplied to the cooler 17 of the cooling load-side. That is, output of chilled water is obtained. On the other side, the intermediate temperature gas acts to heat the hot water when the gas passes through the first heat exchangers 9 and 10. The heated hot water is supplied to the radiator 15 of the heating load-side. In other words, output of hot water is obtained. Namely, by giving a predetermined phase difference to the movement of the first and second displacer pistons 3 and 5, the heat pump apparatus generates cycles for pressure variation, expansion and deflation of the working gas in the external combustion engine 1, heat absorption from outside of the engine 1 and heat elimination to the outside of the engine 1.

Also, regarding the external combustion engine 1, operation of the piston can be carried out by the difference of the inside pressure between the cylinder and crank case 25 by suitably setting the section area of the piston rod 21 of the first displacer pistons 3 and the piston rod 22 of the second displacer pistons 5, that is, self-operation of the engine 1 can be achieved.

For the prior art heat pump apparatus abovementioned, the motor connected with the rotation axis 24 is used as a starter for starting the external combustion engine 1. After starting the engine 1, the power supply to the rotation axis 24 is stopped and the rotation axis 24 is moved by self-operation of the external combustion engine 1 at approximately constant rotation speed. Thereby, since the first and second displacer pistons 3 and 5 move a constant frequency, so, the output of chilled and hot water becomes almost constant. That is, the prior art heat pump apparatus has inconvenience of difficulty to adjust the output of chilled and hot water.

Further, though a certain measure of the output of chilled and hot water can be increased and decreased by means of controlling the pressure variation, expansion and deflation of the working gas in the external combustion engine 1 by adjusting the heating volume of heater tube 6, it is apt to occur overheat of the external combustion engine 1 if carried to the extreme heating volume. In contrast with this, it becomes impossible to keep the self-operation of the external combustion engine 1 if the heating volume is too decreased. Therefore, the apparatus has inconvenience of difficulty to adjust the output of chilled and hot water for wide range.

In order to solve the above problems, an object of the present invention is to provide a heat pump apparatus of which output of chilled and hot water can be adjusted for wide range and operation efficiency can be improved.

SUMMARY OF THE INVENTION

The present invention relates to a heat pump apparatus which comprises a heat pump circuit composed of an external combustion engine, a radiator through which a first medium heated by a first heat exchanger of said external combustion engine flows and a cooler through which a second medium cooled by a second heat exchanger of said external combustion engine flows; motive power supplement means for supplementing a motive power to said external combustion engine; brake means for braking said external combustion engine; detecting means for detecting a heating load loaded on said radiator or a cooling load loaded on said cooler; and a controller for calculating a motive power necessary for said external combustion engine based on the difference between a value detected by said detecting means and a preset value previously set, and for controlling said motive power supplement means to move when the calculated motive power is larger than a self-output of said external combustion engine or for controlling said brake means to move when the calculated motive power is smaller than said self-output of said external combustion engine.

In such a manner, regarding the heat pump apparatus of the present invention, said controller controls said motive power supplement means to move when the calculated motive power is larger than said self-output and said brake means to move when the calculated motive power is smaller than said self-output. Thereby, the working speed of the displacer piston is increased and decreased and the number of expansion of low temperature gas per unit time in the low temperature side cylinder and the number of reciprocations of the intermediate temperature gas per unit time in the heat exchanger for radiation use are increased and decreased for wide range. By these actions, the quantity of heat of low temperature gas absorbed from the chilled water and the quantity of heat of intermediate temperature gas radiated to the hot water, in other words, the output of chilled and hot water can be adjusted.

In the present invention, it is desirable that the detecting means are applied with a detector which detects at least one heat medium among said first medium, said second medium, a third medium which said radiator has and receives heat in said radiator and heats the heated portion, and a forth medium which said cooler has and gives heat in said cooler and cools the portion to be cooled.

In the present invention, it is desirable that the controller comprises:

motive power supplement control means for operating the motive power supplement means; brake control means for operating the brake means; comparison means for comparing the calculated motive power with self-output of the external combustion engine, and for instructing the motive power supplement means to move when the calculated motive power is larger than the self-output or for instructing the brake means to move when the calculated motive power is smaller than the self-output.

BRIEF DESCRIPTION OF THE DRAWINGS

FIG. 1 is a schematic flow diagram showing a piping system of a heat pump apparatus.

FIG. 2 is a graph showing an embodiment of relation between motive power and number of revolution of an external combustion engine.

FIG. 3 is a flowchart of the heat pump apparatus.

FIG. 4 to FIG. 7 are schematic representations of movement of the external combustion engine respectively showing the positional relation of two displacer pistons at each $\frac{1}{4}$ rotation.

FIG. 8 is a graph showing cyclic pressure variation of the working gas at one revolution and volume variation of the spaces of cylinder head-side and the opposite side.

DETAILED DESCRIPTION OF THE PREFERRED EMBODIMENTS

Figure 1:
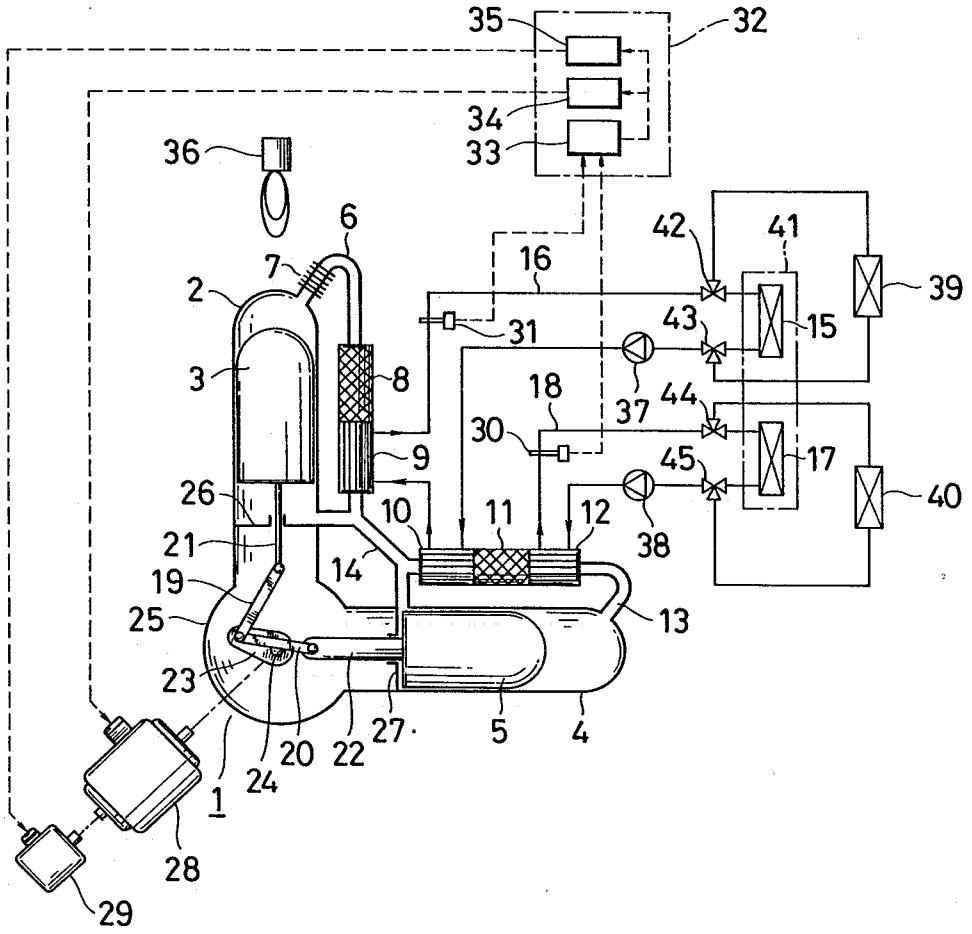
FIG. 1 to FIG. 8 are drawings showing an embodiment of the present invention.
Figure 9:
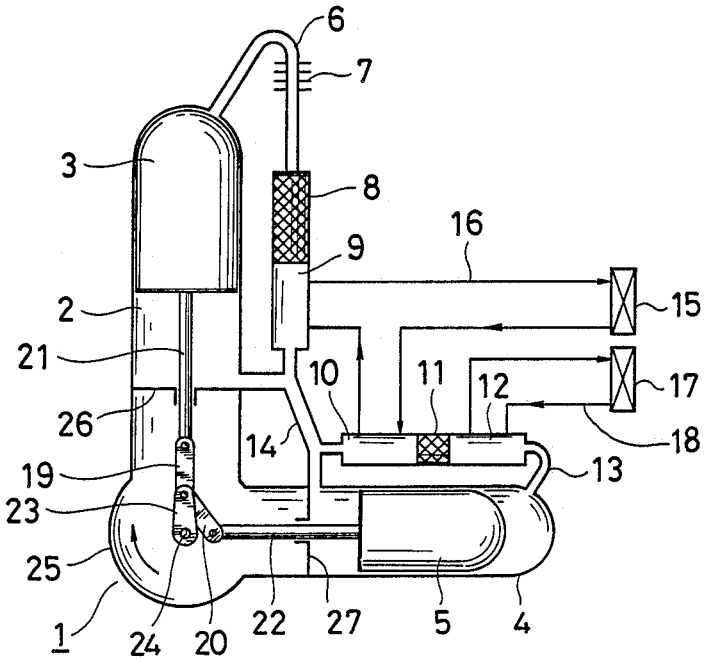
FIG. 9 (PRIOR ART)
FIG. 9 is a schematic flow diagram showing a piping system of a prior art apparatus.

FIG. 1 is a piping system diagram of a heat pump apparatus showing of an embodiment of the present invention and the identical symbols are attached as shown in FIG. 9 of the prior art apparatus.

Figure 2:
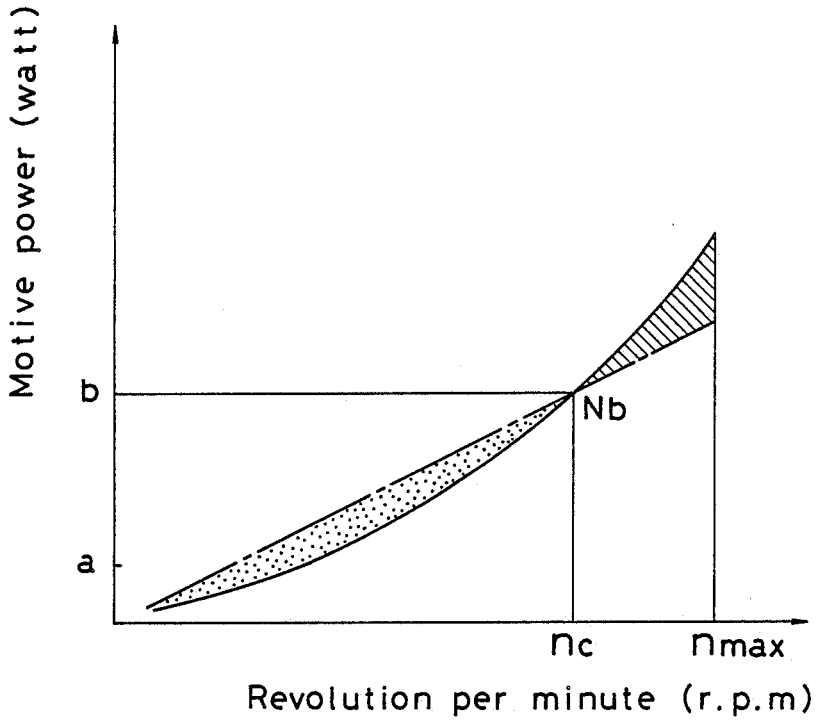

In FIG. 1, reference numeral 28 denotes a variable revolution number motor connected with the revolution axis 24, as backup means for backing up power for the under-mentioned external combustion engine. Reference numeral 29 denotes a brake for braking the revolution of the rotation axis 24, as braking means for braking the power. Reference numeral 30 denotes a detector for cooling use for detecting the temperature of a second medium of chilled water and others flowing through the chilled water pipe line 18. Reference numeral 31 denotes a detector for heating use for detecting the temperature of a first medium of hot water and others flowing through the warm water pipe line 16. Reference numeral 32 denotes a controller consisting of microcomputers for controlling the number of revolution of rotation axis 24 corresponding to the difference between the temperature detected by the detectors 30 and 31, and a setting temperature of cooling and heating. And, as shown in FIG. 2, the number of revolution $n_c$ of self-operation of the rotation axis 24 driven by the external combustion engine 1 is set a value smaller than the maximum value $n_{max}$ of the required number of revolution calculated with the controller 32 using the aforementioned difference of temperature. So, the controller 32 consisting of microcomputers comprises comparison means 33 for comparing the required number of revolutions with number of revolution of self-operation $n_c$, backup control means 34 for so driving the motor 28 as to raise the number of revolution of the rotation axis 24 to the required number of revolution when the command indicating that the required number of revolution exceeds the number of revolution of self-operation $n_c$ is sent from the comparison means 33, and conversely, braking control means 35 for so operating the brake 29 as to lower the number of revolution of the rotation axis 24 to the required number of revolution when the command indicating that the required number of revolution is below the number of revolution of self-operation $n_c$ is sent from the comparison means 33.

Reference numeral 36 denotes a burner for heating the heater tube 6 and the outer surface of head of the high temperature-side cylinder 2. Reference numeral 37 denotes a circulating pump located on the hot water piping line 18. Reference numeral 38 denotes a circulating pump located on the chilled water piping line 16. Reference numerals 39 and 40 denote heat exchangers for exhaust heat use located in the open air. Reference numeral 41 denotes an indoor unit with the radiator 15 and cooler 17 located in a living room. Reference numeral 42 and 43 denote three-way valves for heating use guiding the first medium to the radiator 15 during heating operation and to the heat exchanger 39 during cooling operation. Reference numeral 44 and 45 denote three-way valves for cooling use guiding the second medium to the cooler 17 during cooling operation and to the exchangers for exhaust heat use 40 during heating operation.

Further, the diameter of the piston rod 22 has a dimension four times of that of piston rod 21 and the phase angle between the connecting rods 19 and 20 is about 90°.

The abovementioned FIG. 2 is a graph showing an embodiment of relation between number of revolution of the rotation axis 24 and forces such as generated motive-power of an external combustion engine 1 (alternate long and short dash line in the graph), frictional resistance against the operation of the external combustion engine 1, flow resistance of the working gas and others (hereafter referred to as load power) (curve in the graph), and the number of revolutions (r.p.m.) is exhibited in the axis of abscissas and the power (watt) is exhibited in the axis of ordinates. Further, the point a (watt) as shown in FIG. 2 shows the load power of the external combustion engine 1 at the starting time. Also, the intersection of the dash line and curve $N_b$ shows the balance point of the generated power with load power of the external combustion engine 1. And, the point $n_c$ exhibits the number of revolution of the rotation axis 24 of the external combustion engine 1 during self-operation, and the point b (watt) shows the power of the external combustion engine 1 during self-operation. Further, the slope of the dash line is varied by changing the designing conditions of the external combustion engine 1.

Figure 3:
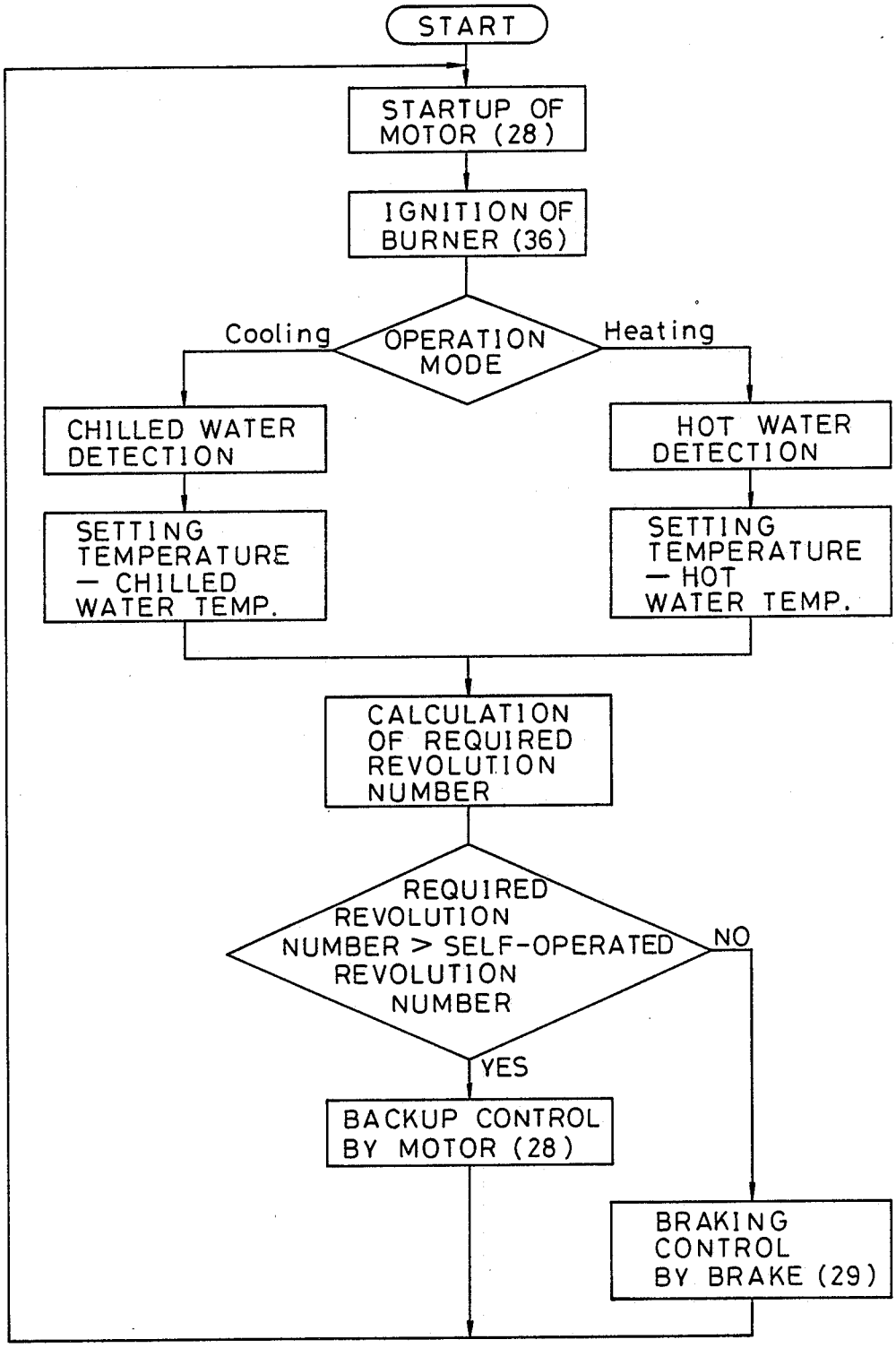
Figure 4:
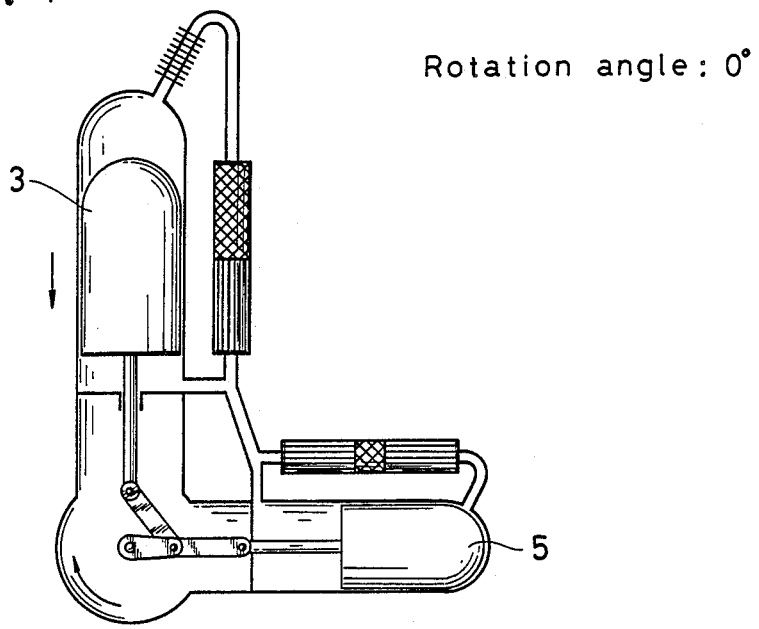
Figure 5:
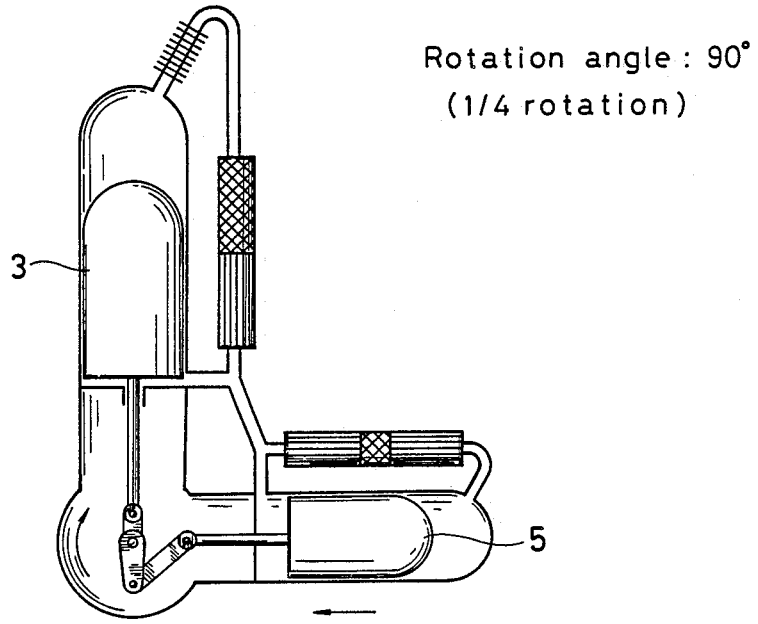
Figure 6:
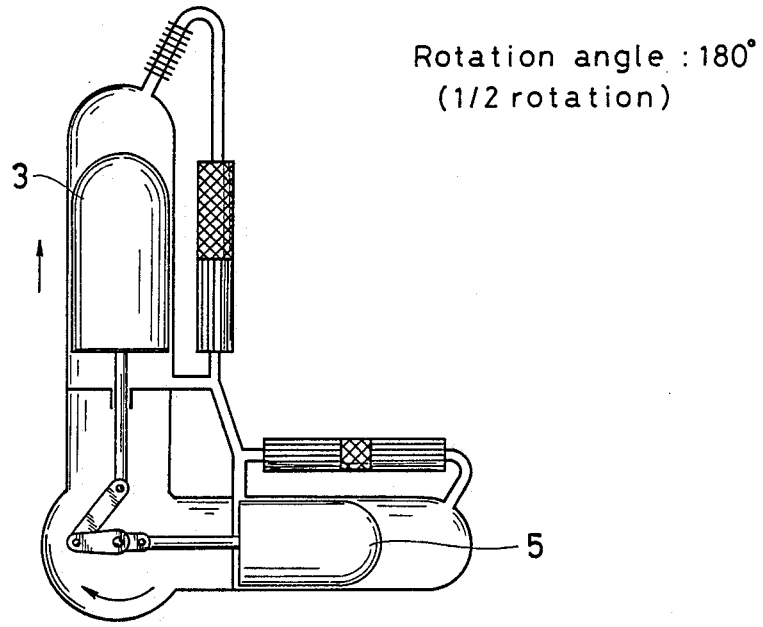
Figure 7:
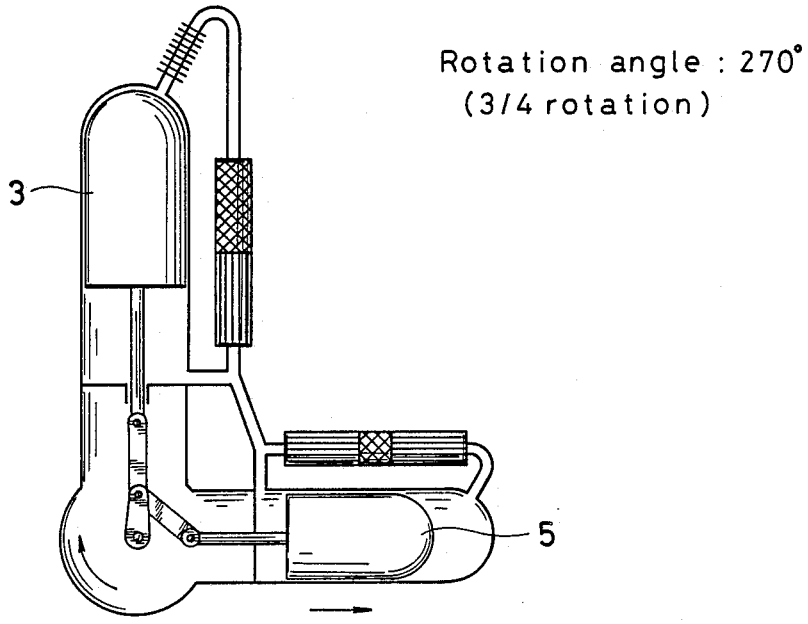
Figure 8:
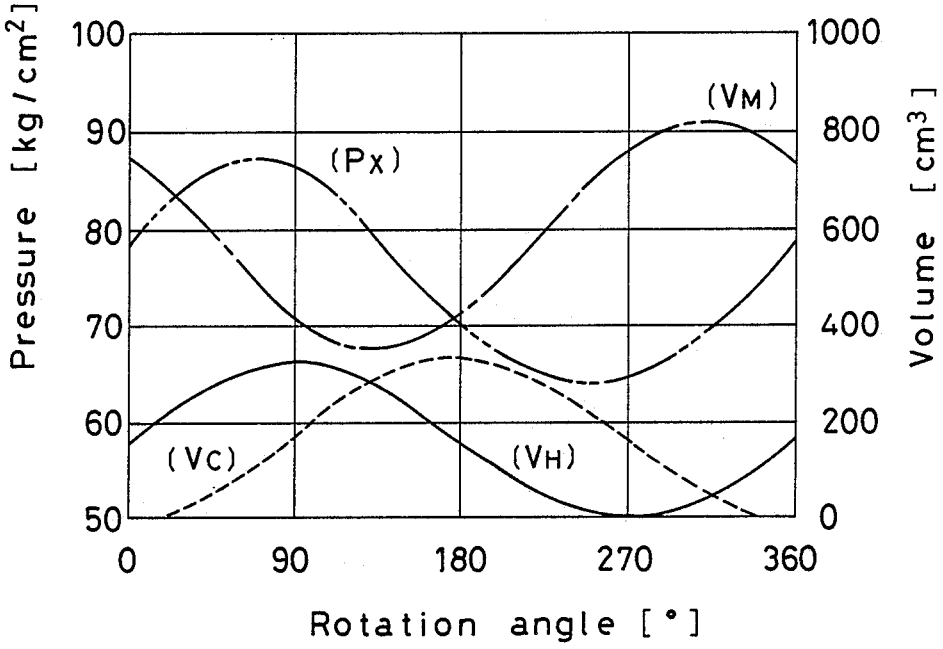

Next, the operation procedures will be described according to the flowchart in FIG. 3. At starting, by driving the motor 28 as a starter, the rotation axis 24 begins to rotate and combustion of the burner 36 is started to heat the working gas. By starting the revolution of the rotation axis 24, the first and second displacer pistons 3 and 5 start to slide on the cylinders 2 and 4 while keeping a constant phase difference. Thereby, the each volume of the head-side and opposite-side spaces of the cylinders is varied as shown in FIG. 4 to FIG. 7, and then the working gas is heated in the heater tube 6 while the gas reciprocates in these spaces. On the other side, by giving and receiving the heat, for example, radiating heat, in the first heat exchangers 9 and 10, as shown in FIG. 8, cyclic expansion and deflation in the space of which volume varies, and pressure variation of the working gas are repeated in the external combustion engine 1, therefore, output of chilled and hot water is generated. That is, output of warm water is generated by the heat radiation of the working gas in the first heat exchangers 9 and 10, and output of chilled water is generated by heat absorbing action occurring through the second heat exchanger 12 and following to the cyclic expansion of the working gas in the variable space at head-side of the low temperature side cylinder 4.

Further, FIG. 4 to FIG. 7 are schematic representations of movement of the external combustion engine 1 respectively showing the positional relation of the first and second displacer pistons 3 and 5 of the rotation axis 24 at each ¼ rotation (90°). The allows in the drawings exhibit the sliding direction of the first and second displacer pistons 3 and 5 and rotational direction of the rotation axis 24. Also, FIG. 8 is a graph showing cyclic pressure variation of the working gas at one revolution of the rotation axis 24 and volume variation of the spaces of cylinder head-side and the opposite side. In the graph, the continuous line shows the volumetric variation ($V_H$) of the head-side of the cylinder 2, the broken line shows the volumetric variation ($V_C$) of the head-side of the cylinder 4 and the alternate long and short dash line shows the volumetric variation ($V_M$) of the opposite-sides of these cylinders and the alternate long and two short dashes line shows the pressure variation ($P_X$) of the working gas.

After the external combustion engine 1 is started, the state gradually moves to stationary state while repeating the aforesaid movement and the working gas in the head-side space of the cylinder 2 becomes high temperature gas of desired high temperature level. On the other hand, the working gas in the head-side space of the cylinder 4 becomes low temperature gas of desired low temperature level and the working gas in the opposite-side spaces of these cylinders becomes intermediate temperature gas of desired intermediate temperature level. By following to this, the generated power of the external combustion engine 1 is also gradually increased and the power is balanced with the load power in the stationary state. And, the number of revolution of the rotation axis 24 becomes the value $n_c$ (refer to FIG. 2) so that the rating output of chilled and hot water can be obtained from the external combustion engine 1.

Here, the rating output of chilled water obtained by self-operation of the external combustion engine 1 is too excessive against, for example, the cooling load, the temperature of chilled water outlet of the second heat exchanger 12 is lowered below the setting temperature. The temperature lowering is discriminated by the difference between chilled water temperature detected by the detector 30 and the setting temperature, and the required number of revolution calculated based on the temperature difference is compared with the number of revolution of self-operation $n_c$ by the comparison means 33. Thereby, braking control means 35 are activated by the command indicating that the required number of revolution is below the number of revolution of self-operation $n_c$, and the brake 29 is operated by the controller 32 to lower the number of revolution of the rotation axis 24 to the required number of revolution. In this way, since the number of expansion per unit time is decreased and the heat absorbed quantity is also decreased in the low temperature-side cylinder 4, the output of chilled water corresponding to the cooling load can be picked out. Conversely, when the output of chilled water is insufficient against the cooling load, the backup control means 34 are activated by a command sent from the comparison means 33 and indicating that the required number of revolution exceeds the number of revolution of self-operation $n_c$, and thereby the motor 28 is driven by the controller 32 to raise the number of revolution of the rotation axis 24 to the required number of revolution. In this way, since the number of expansions per unit time is increased and the heat absorbed quantity is also increased in the cylinder 4, the output of chilled water corresponding to the load can be picked out during cooling operation. The case is the same as the case when the output of hot water is picked out to carry out heating. The required number of revolution calculated based on the temperature difference between hot water temperature detected by the detector for heating use 31 and the setting temperature is compared with the number of revolution of self-operation $n_c$ by the comparison means 33. When the required number of revolutions is below the number of revolutions of self-operation $n_c$, the brake 29 is operated by the braking control means 35 to lower the number of revolution of the rotation axis 24 to the required number of revolution. Conversely, when the required number of revolution exceeds the number of revolution of self-operation $n_c$, the motor 28 is driven by the backup control means 34 to raise the number of revolution of the rotation axis 24 to the required number of revolution.

In such a manner, the number of revolution of the rotation axis 24 can be controlled by the brake 29 and motor 28 in the wide range by increasing and decreasing from the point $n_{max}$ to about zero as shown in FIG. 2. Furthermore, the output of chilled and hot water of self-operation of the external combustion engine 1 can be adjusted while setting the generated power b watt without overs and shorts. And, it is unnecessary to increase and decrease the combustion volume of the burner 36 excessively in order to increase and decrease the number of revolutions of the rotation axis 24, so the external combustion engine 1 will not be overheated mostly and the operation will not be interrupted mostly by shortage of the generated power caused by shortage of the heating for the external combustion engine 1. In other words, the output of chilled and hot water can be adjusted for wide range without interruption of operation which causes the lowering of operation efficiency. As a suitable designing condition for setting the generated power b watt by the self-operation of the external combustion engine 1 without overs and shorts, it is desirable to set a value 50 to 90% of the maximum value $n_{max}$ of the required number of revolution as the number of revolution $n_c$ of self-operation of the external combustion engine 1. If a value below 50% of the maximum value $n_{max}$ is set as the number of revolution of self-operation, a motor 28 having maximum capacity will be required. And if a value over 90% of the maximum value $n_{max}$ is set as the number of revolution of self-operation, large braking force will be required and it will cause the lowering of efficiency. The designing conditions are selected based on the designing values such as frictional resistance of the driving part of the external combustion engine 1, flow resistance of the working gas, thermal resistance of the external combustion engine 1, cross sectional area of the piston rods 21 and 22, the pressure and temperature of the working gas, and others.

Since the generated power of the external combustion engine 1 is increased or decreased by the pressure difference between internal pressure of the crank case 25 and internal pressure of respective cylinders 2 and 4, and also torque of the rotation axis 24 is increased or decreased mainly by dimensions of the cross sectional area of the piston rod 22 of the low temperature-side cylinder 4, the generated power of the external combustion engine 1 also can be changed by changing the cross sectional area. In other words, the slope of the alternate long and short dash line shown in FIG. 2 can be changed.

Further, according to the embodiment abovementioned, the brake 29 may be connected indirectly with the rotation axis 24 via the motor 28, or connected directly with the motor 28. If a motor having both functions of the brake 29 and motor 28 is applied, these equipments can be combined in one united body. Also, by providing a means for transfer to the generator torque added from the rotation axis 24 to the brake 29 on the external combustion engine 1, the motive power of the external combustion engine 1 can be utilized for generation of electricity while the brake 29 is operated.

In the abovementioned embodiment, temperature of hot water which is the first medium is detected during heating operation and temperature of chilled water which is the second medium is detected during cooling operation. However, it is necessary to detect the temperature of chilled water by flowing hot water through the radiator 15 and chilled water through the cooler 17 at the same time while dehumidifying operation when room air cooled and dehumidified by the cooler 17 is heated by radiator 15. However, temperature of mediums such as room air and others having been carried out heat exchange by the radiator 15 or cooler 17 may be detected in stead of detection for the hot and chilled water. Also, the radiator 15 can be applied for hot-water supply use other than heating use and the cooler 17 can be applied for cold storage, refrigeration or freezing uses other than cooling use.

As described in the above, regarding the heat pump apparatus of the present invention, after setting a value less than the maximum value of the required number of revolutions as the number of revolution of rotation axis, the number of revolution of the rotation axis can be conformed and an appropriate output of chilled and hot water corresponding to the load can be obtained by driving the motor when the required number of revolution exceeds the number of revolution of self-operation, and conversely, the number of revolution of the rotation axis also can be conformed and an appropriate output of chilled and hot water corresponding to the load can be obtained by activating the brake when the required number of revolutions is below the number of revolution of self-operation.

In addition, by setting the number of revolution of self-operation of the external combustion engine to a value 50 to 90% of the maximum value of the required number of revolution, a brake and motor respectively having small capacity are sufficient to be applied for the apparatus and an effective operation can be achieved.

What is claimed is:

1. A heat pump apparatus comprising:

a heat pump circuit composed of an external combustion engine, a radiator through which a first medium heated by a first heat exchanger of said external combustion engine flows and a cooler through which a second medium cooled by a second heat exchanger of said external combustion engine flows;

motive power supplement means for supplementing a motive power to said external combustion engine;

brake means for braking said external combustion engine;

detecting means for detecting a heating load loaded on said radiator or a cooling load loaded on said cooler; and a controller for calculating a motive power necessary for said external combustion engine based on the difference between a value detected by said detecting means and a preset value previously set, and for controlling said motive power supplement means to move when the calculated motive power is larger than a self-output of said external combustion engine or for controlling said brake means to move when the calculated motive power is smaller than said self-output of said external combustion engine.

2. A heat pump apparatus according to claim 1 wherein said controller controls said motive power supplement means to move so as to supplement a wanting motive power of said self-output of said external combustion engine in comparison with the calculated motive power, and said brake means to move so as to cancel an excessive motive power of said self-output of said external engine in comparison with the calculated motive power.

3. A heat pump apparatus according to claim 1 wherein said heat pump circuit has a portion to be heated and a portion to be cooled, said radiator has a third medium which receives heat therein and heats said portion to be heated, said cooler has a forth medium which gives heat therein and cools said portion to be cooled, and said detecting means are a detector which detects at least one heat medium among said first medium, said second medium, said third medium and said forth medium.

4. A heat pump apparatus according to claim 1 wherein said self-output of said external combustion engine is 50 to 90% of the maximum calculated motive power.

5. A heat pump apparatus according to claim 1 wherein said controller comprises:

motive power supplement control means for operating said motive power supplement means;

brake control means for operating said brake means;

comparison means for comparing the calculated motive power with said self-output of said external combustion engine, and for controlling said motive power supplement means to move when the calculated motive power is larger than said self-output or for controlling said brake means to move when the calculated motive power is smaller than said self-output.

6. A heat pump apparatus according to claim 1 wherein said external combustion engine has a rotation axis thereof, said motive power supplement means are a motor which is connected with said rotation axis.

7. A heat pump apparatus according to claim 1 wherein said motive power supplement means and said brake means comprise a motor with functions of braking as one united body.

* * * * *